United States Patent [19]

Graizzaffi

[11] 4,036,040

[45] July 19, 1977

[54] REMOTE CONTROL DEVICE FOR KEY ACTUATED SYSTEMS

[76] Inventor: Carmelo C. Graizzaffi, 22 Foster Road, Lake Bonkonkoma, N.Y. 11779

[21] Appl. No.: 603,248

[22] Filed: Aug. 8, 1975

[51] Int. Cl.[2] ..... E05B 17/00; A47G 29/10

[52] U.S. Cl. ..... 70/431; 70/456 R

[58] Field of Search ..... 70/237, 252, 254, 255, 70/256, 257, 393, 423, 431, 442, 444, 456 R, 461; 123/179 B; 290/37 A; 200/331, 161

[56] References Cited

U.S. PATENT DOCUMENTS

| | | | |
|---|---|---|---|
| 519,605 | 5/1894 | Von Honefeld | 70/423 |
| 1,480,813 | 1/1924 | Boone | 70/393 X |
| 2,591,618 | 4/1952 | Schaeffer | 290/37 A |
| 2,837,909 | 6/1958 | Ricci | 70/456 R |
| 3,062,033 | 11/1962 | Schmalfeldt | 70/256 |
| 3,507,259 | 4/1970 | Lankford | 123/179 |
| 3,911,752 | 10/1975 | Olson | 74/10 A |

*Primary Examiner*—Robert L. Wolfe
*Attorney, Agent, or Firm*—Kevin Peter Redmond

[57] ABSTRACT

A remote starting device for key actuated ignition systems comprising a key holder, a body member, an adjustable arm and a flexible line. The key holder and arm are secured to opposite ends of the body member and each is positioned to permit rotation of an ignition key held in the holder about the key axis when a force is applied to the arm. The line is attached to the arm and rotation of the key is obtained at a remote location by pulling the line. The angular positions of the arm and the key with respect to the body member are adjustable to provide a means of avoiding mechanical interferences while actuating ignition switches located in various positions within a vehicle from a variety of remote locations.

7 Claims, 10 Drawing Figures

REMOTE CONTROL DEVICE FOR KEY ACTUATED SYSTEMS

BACKGROUND

1. Field

This invention relates to means for remotely starting key actuated ignition systems and more particularly to starting automotive ignition systems.

2. Prior Art

While carrying out repairs, it was possible with older model automobiles to start the engine from the engine compartment by connecting a switch in parallel with the ignition switch; however, the relatively easy access to the connection points for such a switch is not present in the more recent models.

A one piece during consisting principally of a lever attached to the ignition key and remotely actuated by a flexible cord has been proposed to overcome this problem. Unfortunately, such a device does not offer the flexibility required in many practical applications. For example, most dash mounted key actuated ignition switches are turned in a clockwise direction to start the engine. In some vehicles the ignition switch is located on the left-hand side of the dash near the door. If the fixed lever extends downward from the key axis, it must be pulled by a line passing through the window to the left of the driver. The line is brought upward from the ignition switch in order to pass through the window and therefore the line is not in a direction with respect to the lever which will produce rotation of the key when tension is applied to the cord.

A problem posed by the more recently produced automobiles, which have the ignition switch on the steering column, is the line must generally be passed over the steering wheel before it can be brought out through a window. This is necessary if the line is to be in the correct direction for actuating the ignition switch. When a fixed lever device is used, the position of the lever with respect to the steering wheel may make it difficult or impossible to rotate the key. FIG. 9 is a perspective view of a prior art starting device in which a fixed lever is in a position which may prevent actuation of the ignition switch.

Finally, the fixed lever also suffers from the inability to avoid mechanical interferences. A knob or other object located near the ignition switch can prevent actuation.

SUMMARY

It is an object of this invention to provide a remote starting device for key actuated ignition systems which overcomes the disadvantages of the prior art electrical and mechanical devices discussed above. More specifically, it is an object of this invention to provide an adjustable arm which may be placed at any desired angle with respect to the key axis to avoid mechanical interferences and which can be actuated remotely from either side of an automobile and with the ignition switch located in various positions in the automobile, such as on the steering column.

It is still another object to provide a device which will prevent damage to a key from excessive tension applied to the line. It is a further object to provide a remote starting device which is collapsible to facilitate convenient storage.

Fundamentally, the present invention is a device with an adjustable arm designed to be connected to an ignition key with the arm set at a selected angle with respect to the key. A flexible line attached to the arm causes the arm and the key to rotate when the line is pulled from a remote location. Releasing the line permits the spring bias generally found within the ignition switch to return the switch from the "start" position to the "on" or "run" position.

The invention comprises four main elements, a key holder, a body member connected at one end to the key holder, an arm connected to the body member at the end opposite the key holder, and a flexible line, connected to the arm at the end opposite the body member.

The positions of the key and arm are adjustable to avoid mechanical interferences and facilitate operation with the ignition switch located on the dash or steering column. The key may be gripped in the holder at any angle in one plane with respect to the body member and the arm may be set at any angle with respect to the body member.

By virtue of these adjustments, the arm can be set to an angle which permits operation regardless of the orientation of the key slot. For example, the arm can be set in a direction to the left of the key when the key is inserted in a dash mounted ignition switch located on the left-hand side of the dash close to the door. The flexible line may then be taken upward and then out the window to the left of the driver to obtain clockwise rotation of the ignition switch.

Damage to the ignition switch is prevented by fabricating the arm of resilient wire to absorb the shock produced by a strong pull on the line.

The body member comprises two plates to provide strength and rigidity. The plates may be separated sufficiently to provide a convenient space within which the key and the arm may be folded and stored when not in use.

PREFERRED EMBODIMENT

Figure 1:
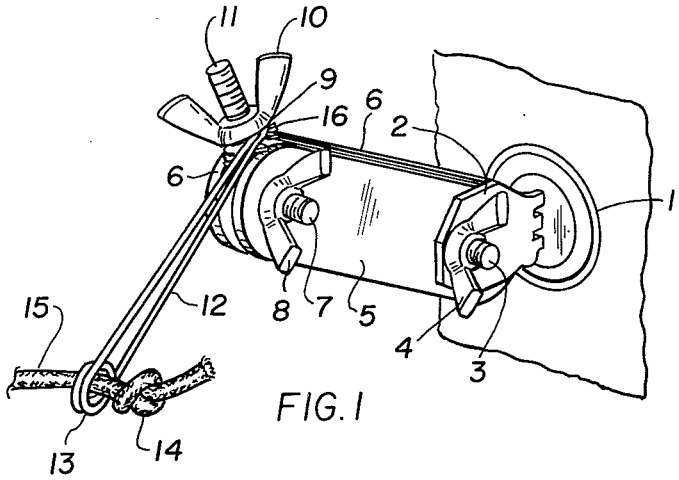
FIG. 1 is a perspective view of the invention.

Referring to FIG. 1, the four main elements of the invention comprise a flexible line 15, an arm 12, a body member and key holder. The body member includes two generally parallel plates 5 and 6. The key holder comprises a bolt 3 and a wing nut 4.

The arm 12 is fabricated from resilient material such as spring wire and is formed into a loop at each end. The loop 9 at the first end is adapted to accept the shaft of an eye bolt 11 which is connected to the body member. The other end is formed into a loop 13 which accepts the flexible line 15. The line 15 is prevented from slipping through the loop 13 by any suitable means such as the knot 14. The arm is held in a selected position against the body member by a wing nut 10 threaded on eye bolt 11. A serrated lock washer 16 located between the arm and the body member aids in preventing movement of the arm when wing nut 10 is tightened.

Figure 2:
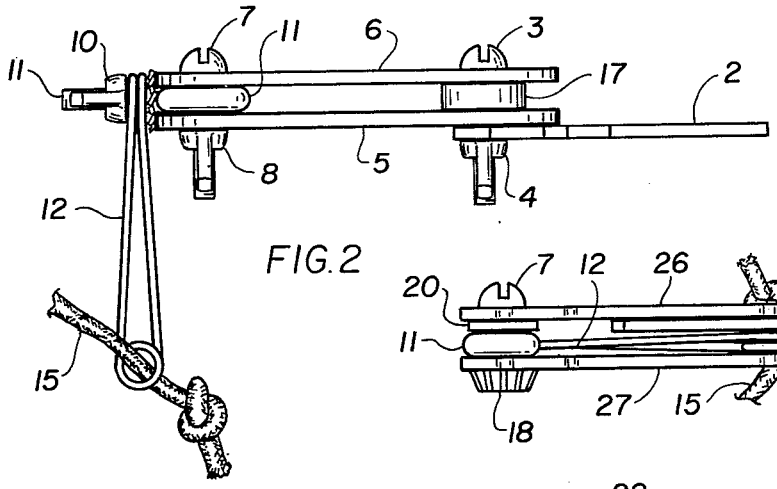
FIG. 2 is a top view of the invention.

Referring to FIG. 2, the eye of the bolt 11 is positioned between the plates of the body member and is rotatably mounted on the shaft of a bolt 7 which passes through both plates of the body member. The bolt 7 is secured in place by wing nut 8. The eye bolt 11 separates the plates 5 and 6 at one end of the body member while a spacer 17 separates the opposite end.

Although the body member is shown in FIG. 2 as comprising two plates to provide rigidity and strength, other configurations may be substituted. For example, a single plate, not shown, may be substituted for the two shown in FIGS. 1 and 2. In a single plate configuration, the eye bolt 11 and the key are secured to one side of the plate.

Figure 3:
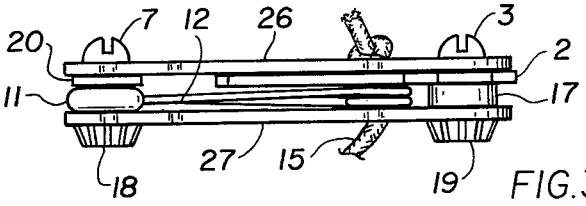
FIG. 3 is a top view of a variation of the invention.

Another variation of the invention is shown in FIG. 3. This variation includes a body member with two plates similar to that shown in FIGS. 1 and 2, but adds a means of folding the key and the arm between the plates to make a more compact package for storage and handling. In this configuration, the head portion of the key is connected to the body member by the bolt 3; however, the key is placed between the plates rather than outside. The wing nuts 4 and 8 of FIGS. 1 and 2 are replaced by lower profile knurled nuts 19 and 18. An additional spacer 20 is placed on the bolt 7 next to the eye bolt 11 to separate the plates sufficiently to allow the loop 13 at the end of the arm 12 to fit between the plates. In this variation of the invention, the plates 26 and 27 comprise the body member, replacing plates 5 and 6 shown in FIGS. 1 and 2.

Figure 4:
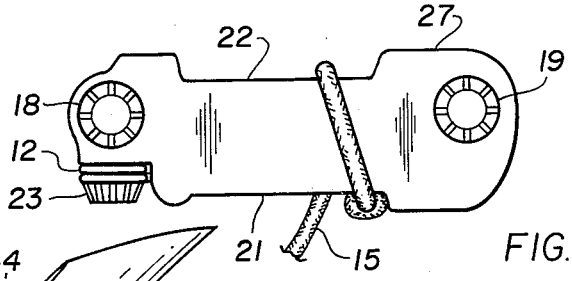
FIG. 4 is a side view of the variation shown in FIG. 3.

Referring to FIG. 4, the upper and lower areas of the plates 26 and 27 include wide notches, such as those indicated by drawing numerals 21 and 22. These notches provide an area in which to wind and store the flexible line 15. Wing nut 10, shown in FIGS. 1 and 2, is replaced by a lower profile knurled nut 23.

Figure 5:
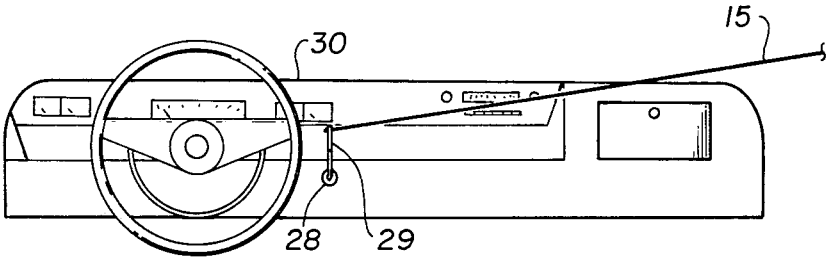
FIG. 5 is a view of the invention connected to an ignition switch located on the dash of an automobile with the line taken out the window to the right of the driver.

Referring to FIG. 5, the invention 29 is shown connected to a key in an ignition switch 28 located on an automobile dash 30. The arm is adjusted to extend upward and the line 15 is guided out a window to the right of the driver.

Figure 6:
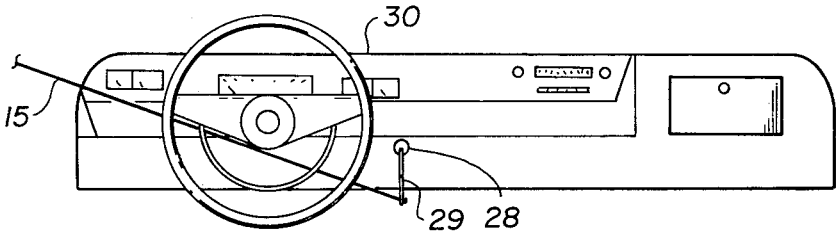
FIG. 6 is identical to FIG. 5 with the exception that the arm is in a different position in order to have the line taken out the window to the left of the driver.

Referring to FIG. 6, the invention 29 is shown projecting downward from the key and the like is guided out the window to the left of the driver to obtain clockwise rotation when tension is applied to the line.

Figure 7:
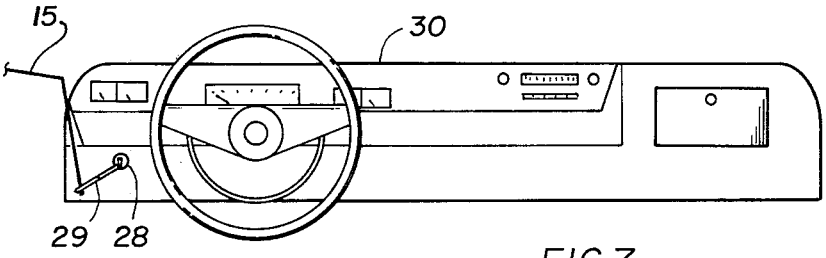
FIG. 7 is identical to FIG. 6 with the exception that the ignition switch is located close to the door to the left of the driver and the arm is again set in a different position to accommodate the direction the line is taken out the window.

Referring to FIG. 7, the invention is shown connected to a key located close to the door left of the driver. The arm is adjusted to be to the left of the key to permit rotation in a clockwise direction when tension is applied to the line. An important advantage of the arm is illustrated by this application as such rotation would be impossible with a device having a fixed lever directed downward from the key.

Figure 8:
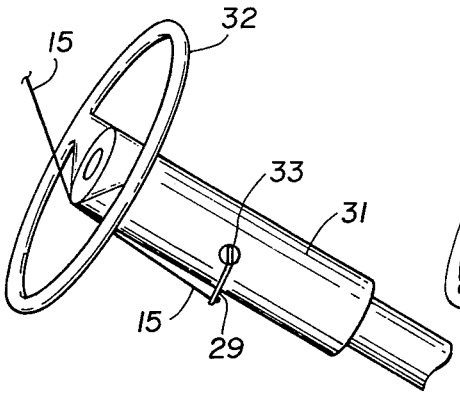
FIG. 8 is a view of the invention connected to an ignition switch located on a steering column.

Referring to FIG. 8, the invention 29 is shown used with an ignition switch 33 located on a steering column 31. The line 15 is guided about a steering wheel 32. In this application, the arm is adjusted to extend downward from the key to provide a means of rotating the key in a clockwise direction when tension is applied to the line.

Figure 9:
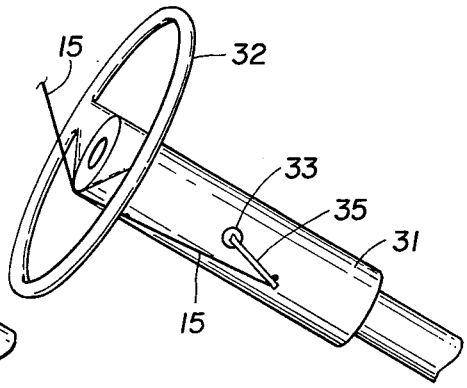
FIG. 9 is a prior art device connected to an ignition switch location on a steering column.

Referring to FIG. 9, a fixed lever of a prior art device 35 is shown connected to an ignition key inserted in an ignition switch 33. The angle the fixed lever makes with the line 15 tends to prevent turning the key when tension is applied to the line.

Figure 10:
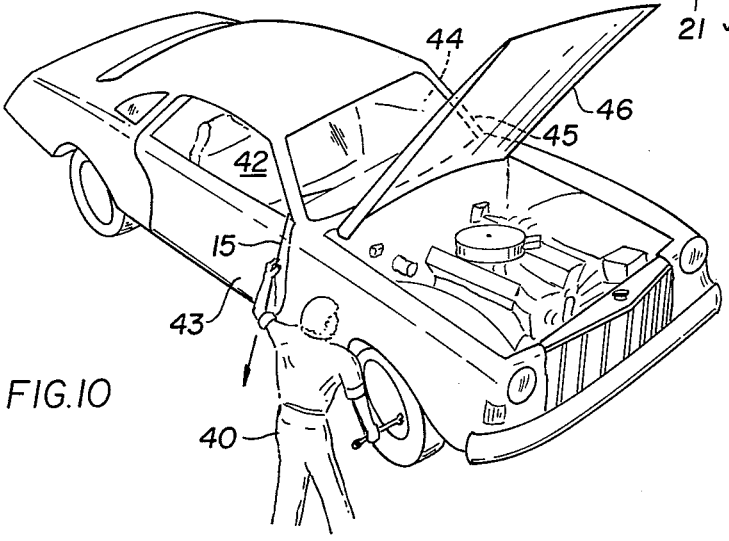
FIG. 10 is a fragmentary perspective view of an automobile in which the invention is installed.

Referring to FIG. 10, the line 15 is guided through the window 42 of automobile 43 where an operator 40 is shown holding the line. Alternately, the line 15 may be brought out a window 44 on the opposite side of the automobile, and past window post 45 and hood 46 to the operator.

In the operation of the invention, an ignition key such as the key 2 shown in FIG. 1 is placed on the shaft of the bolt 3 and secured in place by the wing nut 4. Lock washers, not shown, may be used in conjunction with the nuts to prevent loosening during handling. The invention may be adjusted about the shafts of the three bolts to avoid interferences or to aid in positioning the device to produce key rotation in the proper direction.

The key may be rotated about bolt 3 to any selected position before it is secured by the wing nut 4.

The eye bolt 11 may be rotated about the bolt 7 to adjust the position of the arm with respect to the body member before it is secured in place by the wing nut 10. Note that the end of the body member adjacent the arm is rounded as shown in FIGS. 1 and 4 to provide a surface on which the lock washer 16 may bear regardless of the angle at which the eye bolts is set within a 180° adjustment range.

The serrated lock washer 16 is particularly suited to holding the wire of the arm in place because the wires tend to fall into a serration as the wing nut 10 is tightened, preventing rotation of the arm.

The arm 12 may also be adjusted by rotating it to any selected angle within a range of 360° about the bolt 11 before it is secured by the wing nut 10. These three adjustment points permit the loop 13, to which the line is attached, to be positioned at virtually any angle with respect to the key axis. For example, the body member and the arm may be adjusted to extend vertically above the key to provide a longer effective arm which includes the body member to exert a greater torque on the key for the same line tension.

In this vertical position, the conventional ignition switch on a dash, which requires clockwise rotation, may be actuated directly from the side of the car to the right of the driver, as shown in FIG. 5. Similarly, the arm may be adjusted to the below the key if it is desired to actuate the ignition switch directly from the side to the left of the driver as shown in FIG. 6.

The ability to adjust the arm also avoids the problem encountered with an ignition switch located on a steering column where the key slot is oriented at an angle that prevents rotation with a fixed lever device. FIG. 9 shows a prior art fixed lever device with the lever at an angle with respect to the line which will either retard operation or prevent operation entirely. FIG. 8 shows the same ignition switch with the invention adjusted to permit rotation of the switch.

The position of the ignition switch key slot may vary between different manufacturers and can also vary between different models produced by the same manufacturer. In addition, in older automobiles, where repairs are often required, it is not uncommon for the barrel of the ignition lock to have become loosened and rotated from its original position, necessitating the use of the invention to adjust for the arbitrary position of the lock. The arm of the present invention can be adjusted to accommodate virtually any key slot position, whereas a fixed lever device is often prevented from operating either from interferences or because the projection of the arm orthogonal to the direction of the line is insufficient to provide the requisite torque to rotate the key.

The version of the invention shown in FIGS. 3 and 4 is particularly advantageous for taxicab or truck fleets where a number of vehicles can be operated with a single master key. Mechanics may carry the master key in the invention using the plates as a key case. Whenever it is desired to use the device, the key and the arm are rotated out of the plates and operated as described above. The low profile knurled knobs produce a smoother overall contour suitable for carrying in a pocket.

A third plate with a hole in each end may be substituted for the wire arm; however, the wire arm offers several advantages. The wire is resilient and provides a measure of tolerance to quick, hard pulls in that it returns to its original shape after each pull. The arm's flexibility prevents damage to the device, the key and the ignition switch.

I claim:

1. A remote control device for key actuated ignition systems comprising:

a. an adjustable arm having a first and a second end, b. holding means adapted to hold a key, c. linking means to connect the holding means to the first end of said arm, the key and arm positions being separately adjustable to place the key axis at a selected angle with respect to the axis of the arm, and d. a flexible line secured to the second end of the adjustable arm, and wherein said linking means comprises a body member having a first and a second end, a first coupling means attached to the first end of said body member to connect said holding means to said body member, and a second coupling means attached to the second end of said body member to connect said arm to said body member, and said first and second coupling means including separate means for securing said holding means and arm to the body member at respective selected positions, and wherein said body member includes a first hole adjacent its first end and a second hold adjacent its second end, said first coupling means comprises a first fastening means having a shaft and a head on one end of shaft, such as a bolt, the shaft portion of which is positioned in the first hole in said body member and passes through a hole in the head of the key, and wherein the arm includes a first hole at the end adjacent the body member and said second coupling means comprises a second fastening means having a shaft with a head on one end, such as a bolt, second and third adjustable securing means such as nuts, and a third fastening means having a shaft and an eye at one end of the shaft such as an eye bolt, the shaft portion of said second fastening means being located in the second hole in said body member and passing through the eye of the third fastening means, the second securing means being attached to the second fastening means at an adjustable point on the shaft towards the end opposite the head to secure the third fastening means to said body member, the shaft portion of the third fastening means passing through the first hole in the arm, and said third securing means being attached to the third fastening means at an adjustable point on the shaft towards the end opposite the eye to secure said arm to said body member, whereby said key may be set to any angle about said first fastening means, said third fastening means may be set to any angle within a 180° range about said second fastening means and said arm may be set to any angle about said third fastening means.

2. A remote control device as claimed in claim 1, wherein said arm is comprised of a length of wire formed into a first loop at one end to comprise said first hole which encloses the shaft portion of the third fastening means, and into a second loop at its other end to provide a means of securing the line to said arm.

3. A remote control device as claimed in claim 2, further comprising a washer with a serrated edge located on the shaft of the third fastening means between the arm and the securing means, the wire arm being locked in a selected position by adjusting the position of the third securing means on the shaft of the third fastening means to exert pressure on the arm which rests on the washer which, in turn, rests on the body member.

4. A remote control device as claimed in claim 3, wherein all fastening means are bolts and all securing means are wing nuts to facilitate manual setting of the respective selected angles of the holding means and arm.

5. A remote control device as claimed in claim 1, wherein said body member is comprised of two substantially identical, flat, elonged plates placed generally parallel to one another, and a spacer which is located at the first end of the body member between the plates adjacent the holding means, said spacer having a hole to accept the first fastening means, the shaft portion of the first fastening means being positioned in the first hole of the body member and passing through one plate of the body member, the hole in the spacer, the second plate of the body member, and the head of the key, the key being secured to the body member by the first securing means, the plates being spaced apart at the second end of the body member by the eye of the third fastening means, the shaft portion of the second fastening means being located in the second hole in the body member and passing through one plate of the body member, the eye of the third fastening means, and the second plate of the body member, the second securing means being attached to the second fastening means on the outside of the second plate, both plates of the body member having identical curved ends adjacent the arm to facilitate securing the arm at a selected angle along said curved ends with the third securing means.

6. A remote control device as claimed in claim 3, wherein a second spacer is placed on the second fastening means, the head of the key is placed between the plates of the body member adjacent the first spacer, the plates being separated by the two spacers to accommodate the key and the arm between the plates, whereby the key and arm may be rotated to positions in which they are enclosed on either side by the plates.

7. A remote control device as claimed in claim 1, wherein all fastening means are flat head bolts and all securing means are flat knurled nuts to provide the device with a smooth external contour.

* * * * *

UNITED STATES PATENT OFFICE

CERTIFICATE OF CORRECTION

Patent No. 4,036,040 Dated July 19, 1977

Inventor(s) Carmelo C. Grizzaffi

It is certified that error appears in the above-identified patent and that said Letters Patent are hereby corrected as shown below:

On the title page, item [76] should read:

-- Inventor: Carmelo C. Grizzaffi,
22 Foster Road, Lake
Ronkonkoma, N. Y. 11779 --

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*